US005425144A

United States Patent [19]

Cornelius

[11] Patent Number: 5,425,144

[45] Date of Patent: Jun. 20, 1995

[54] ABOVE GROUND POOL COMPONENTS

[76] Inventor: Kerry J. Cornelius, 40 Leeson Street, St. Catherines, Ontario, Canada, L2P 2R4

[21] Appl. No.: 126,315

[22] Filed: Sep. 24, 1993

[51] Int. Cl.[6] ..... E04H 4/14

[52] U.S. Cl. ..... 4/506; 52/169.7; 52/245; 4/488

[58] Field of Search ..... 4/506, 488; 52/169.7, 52/245

[56] References Cited

U.S. PATENT DOCUMENTS

| | | | |
|---|---|---|---|
| 3,233,251 | 2/1966 | Barrera | 52/245 |
| 3,274,621 | 9/1966 | Diemond et al. | 52/169.7 |
| 3,280,408 | 10/1966 | Gershman | 52/245 |
| 3,440,780 | 4/1969 | Adam et al. . | |
| 3,562,822 | 2/1971 | Wall | 52/245 |
| 3,745,593 | 7/1973 | Wall | 52/169.7 |
| 3,793,651 | 2/1974 | Pitti et al. | 52/169.7 |
| 3,934,277 | 1/1976 | Quirouette et al. | 52/245 |
| 3,955,220 | 5/1976 | Kessler | 4/172.19 |
| 4,167,084 | 9/1979 | Brunton | 52/169.7 |
| 4,229,844 | 10/1980 | Cribben et al. | 52/588 |
| 4,283,804 | 8/1981 | Mahoney | 4/506 Q |
| 4,370,839 | 2/1983 | Blakeway | 52/169.7 |
| 5,155,872 | 10/1992 | Aymes | 4/506 |
| 5,231,807 | 8/1993 | Aymes | 52/245 |

FOREIGN PATENT DOCUMENTS

| | | |
|---|---|---|
| 951853 | 7/1974 | Canada . |
| 968502 | 6/1975 | Canada . |
| 1229453 | 11/1987 | Canada . |
| 2672330 | 7/1992 | France . |
| 2171599 | 9/1986 | United Kingdom . |

*Primary Examiner*—Henry J. Recla
*Assistant Examiner*—Charles R. Eloshway
*Attorney, Agent, or Firm*—Robert M. Phipps

[57] ABSTRACT

An above-ground swimming pool wall construction is disclosed. The pool wall is located and secured in, top and bottom connectors in combination with upright or vertical posts. Top and bottom tracks protect the upper and lower edges of the pool wall and secure it in receptacles in the top and bottom connectors. A finishing cover or cap is provided to cover each upper connector assembly. The track and its associated receptacles on the connectors have a generally triangular configuration in cross-section so as to be captured and located more securely in the connectors. The triangular shaped track may also include a liner bead retainer. The cap design is such that it is fixed in position with no visible means of securement.

5 Claims, 9 Drawing Sheets

ABOVE GROUND POOL COMPONENTS

FIELD OF THE INVENTION

This invention relates to swimming pools and in particular to components used in the construction of above ground pools.

BACKGROUND OF THE INVENTION

Swimming pools of the above ground variety usually comprise an exterior wall of sheet metal construction and formed into a continuous circular or oval shape. A plurality of support or reinforcing posts are located about the perimeter of the pool and serve to strengthen and maintain the pool wall in the desired position. Conventionally, various components make up these post assemblies and may include upper and lower rails for engaging and covering the upper and lower edges of the metal pool wall, some form of plate connectors which serve to mount the vertical posts in position and which may also be utilized to secure sections of coping or upper ledges around the top of the pool wall. Some form of cap is usually fastened to finish the top of the post assembly.

One example of the prior art is shown in U.S. Pat. No. 5,155,872 of Oct. 20, 1992 to Aymes and further examples are found in U.S. Pat. No. 3,955,220 of May 11, 1976 to Kesler.

One of the problems in conventional construction of the assemblies in above ground pools is that the edges of the pool wall are insufficiently secured in their associated rails.

Additionally, many forms of the prior art have fastening members that are both visible and so located as to be a source of snagging a person's clothes or the like thereon.

One of the objects of the present invention is to provide apparatus in an above ground assembly that will provide a more secure track for edges of the metal swimming pool wall.

Another object of the present invention is to provide improved cap members with no visible means of securement thereof to the post assemblies.

According to one broad aspect, the invention relates to apparatus for use in above ground swimming pool construction wherein a perimeter pool wall is secured in position. The apparatus consists of top and bottom connectors for locating the upper and lower edges of the wall and securing the wall thereto as well as providing upper and lower tracks for receiving upper and lower edges of the wall. Receptor means are provided on the connectors for receiving and retaining the tracks on the connectors and ledge members covering the upper edges of the wall extend between and are secured to the top connectors. A cap covers each top connector and the terminal ends of the ledge members associated therewith. The tracks and the connector receptors have a generally triangular configuration in cross section and means fix the cap over the ledge members and the top connector with no visible means of securement from the exterior thereof.

The invention is illustrated by way of example in the accompany drawings in which.

DETAILED DESCRIPTION OF THE INVENTION

Figure 1:
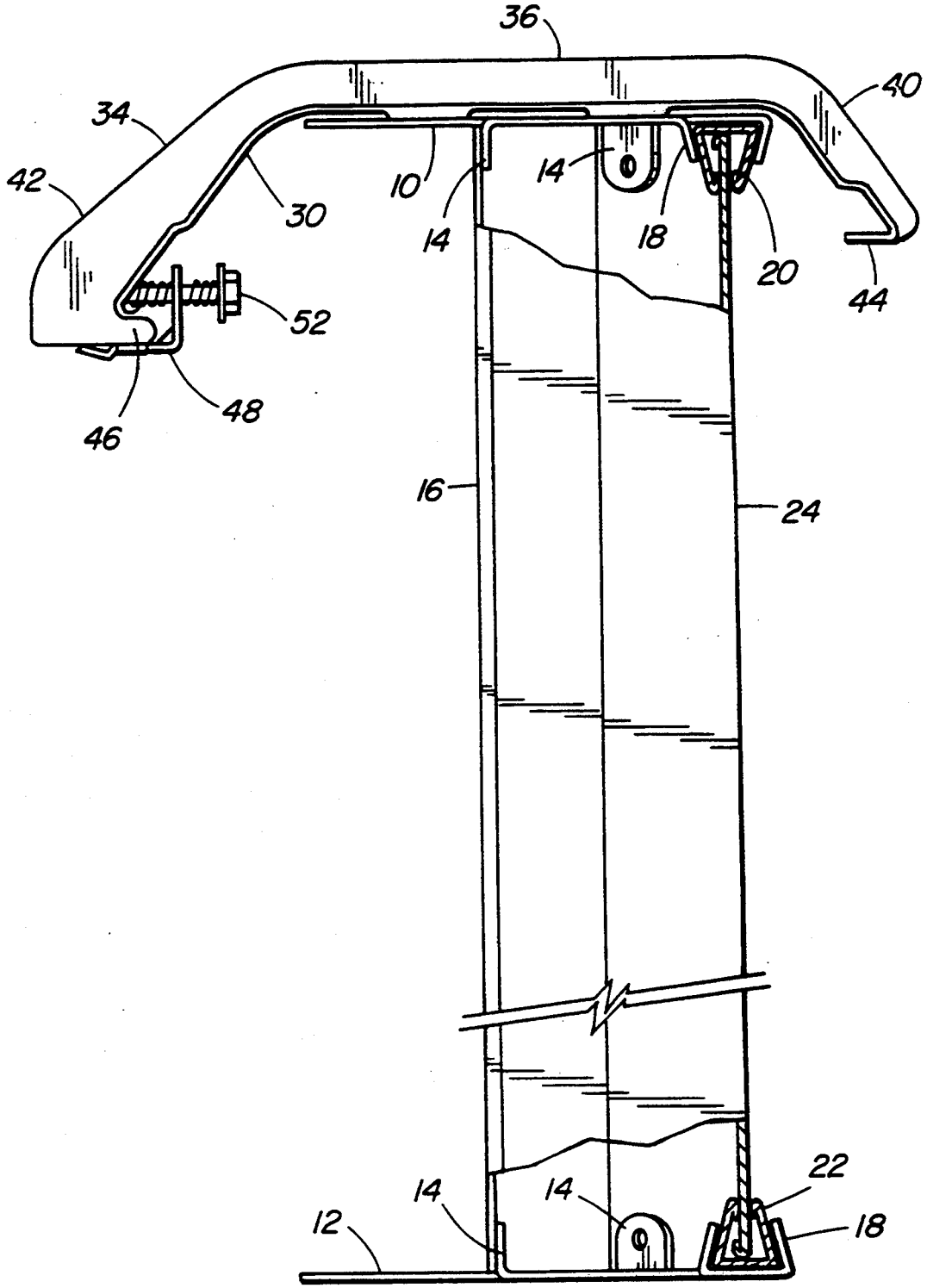
FIG. 1 is a side view of a section a pool wall incorporating apparatus according to the invention.

FIG. 1 is a side view of a section of an above ground swimming pool construction according to the invention.

The apparatus includes a top connector 10 and a bottom connector 12 each of which has a plurality of tabs 14 providing anchors for a vertical post member 16 secured thereto.

Figure 2:
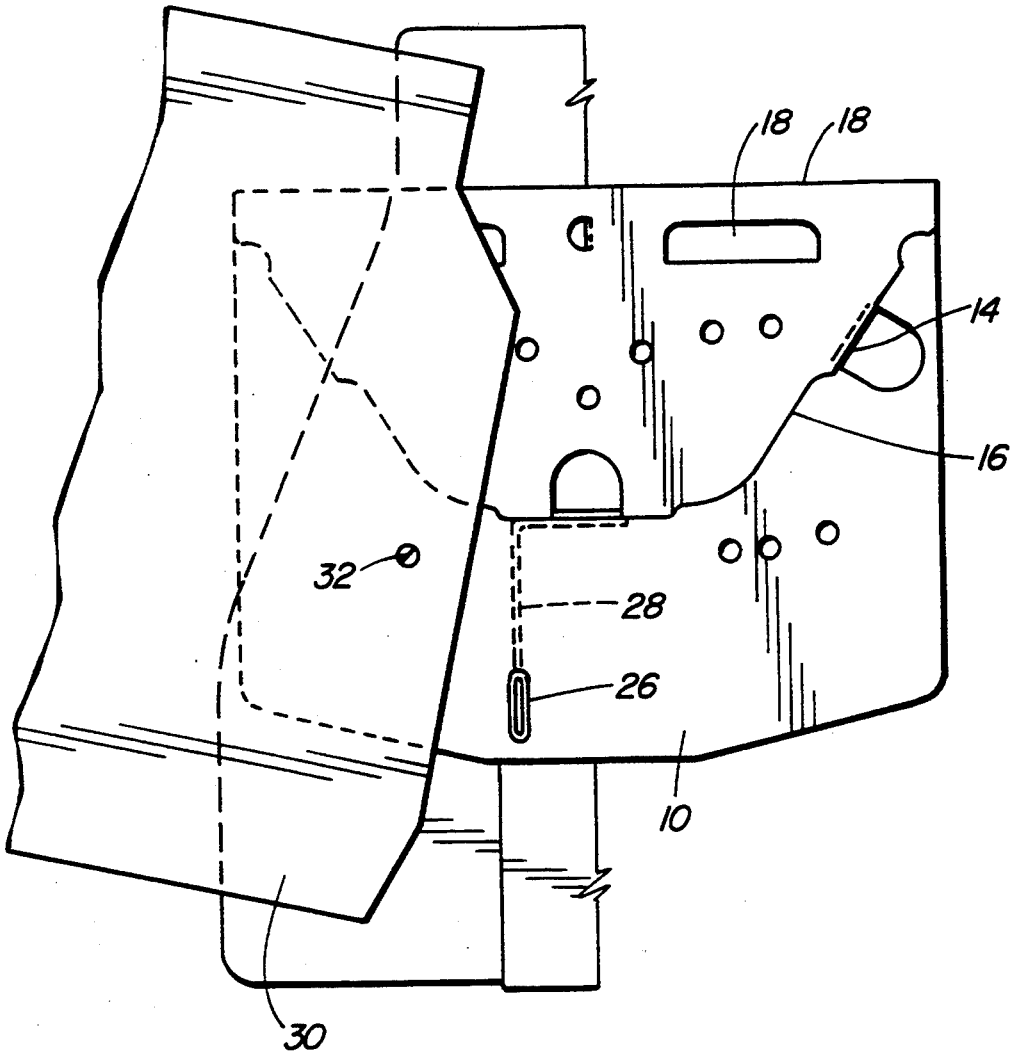
FIG. 2 is a fragmentary plan view of an assembly of the apparatus according to the invention.
Figure 3:
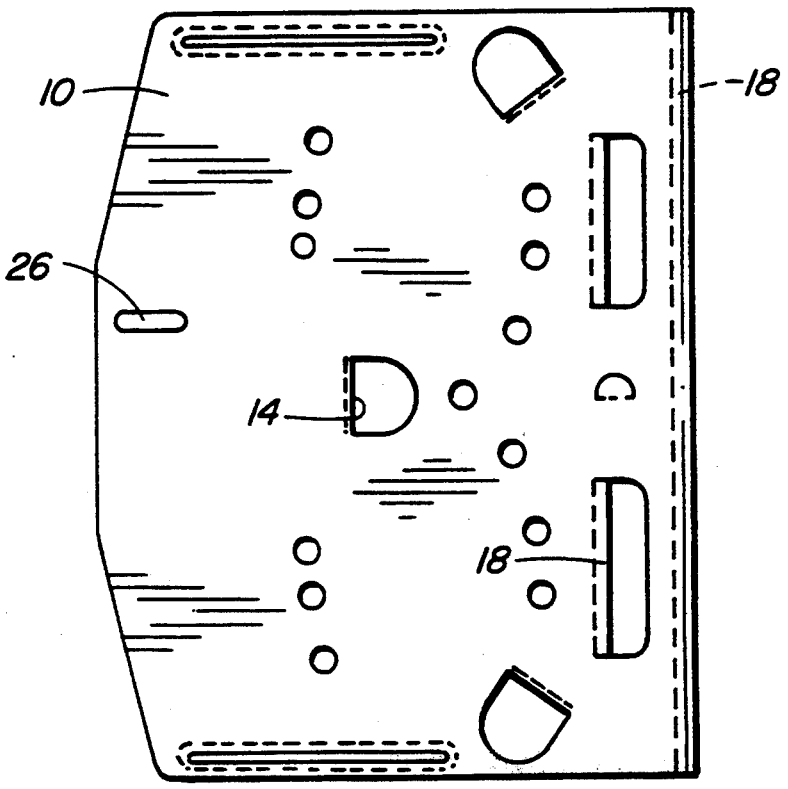
FIG. 3 is a plan view of a connector used in the assembly.
Figure 4:
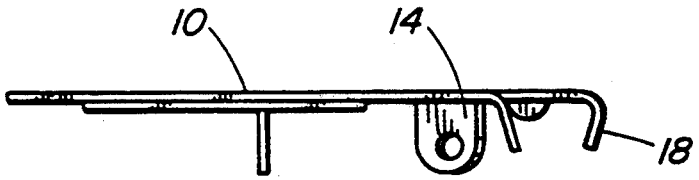
FIG. 4 is a side view of the connector in FIG. 3.

Each connector, 10, 12 includes receptors 18 of generally triangular cross section for receiving and retaining upper and lower tracks 20, 22 respectively that enclose the top and bottom edges of the steel wall 24 of the pool. As shown in FIGS. 2 and 3, the top connector 10 may include a slot 26 for the protrusion therethrough of one leg of a cap support 28. (See FIG. 11).

A plurality of ledge members 30 are located around the top edge of the pool wall and each ledge panel or member 30 extends between adjacent vertical posts 16 and are secured at their terminal ends to the upper connectors 10, by means of screws 32 for example, as shown in FIG. 2.

A finishing cap 34 is placed over the ledge member 30 and is secured thereto. The means of fixing the cap is such that there is no visible means of securement to the ledge from the exterior thereof.

Figure 5:
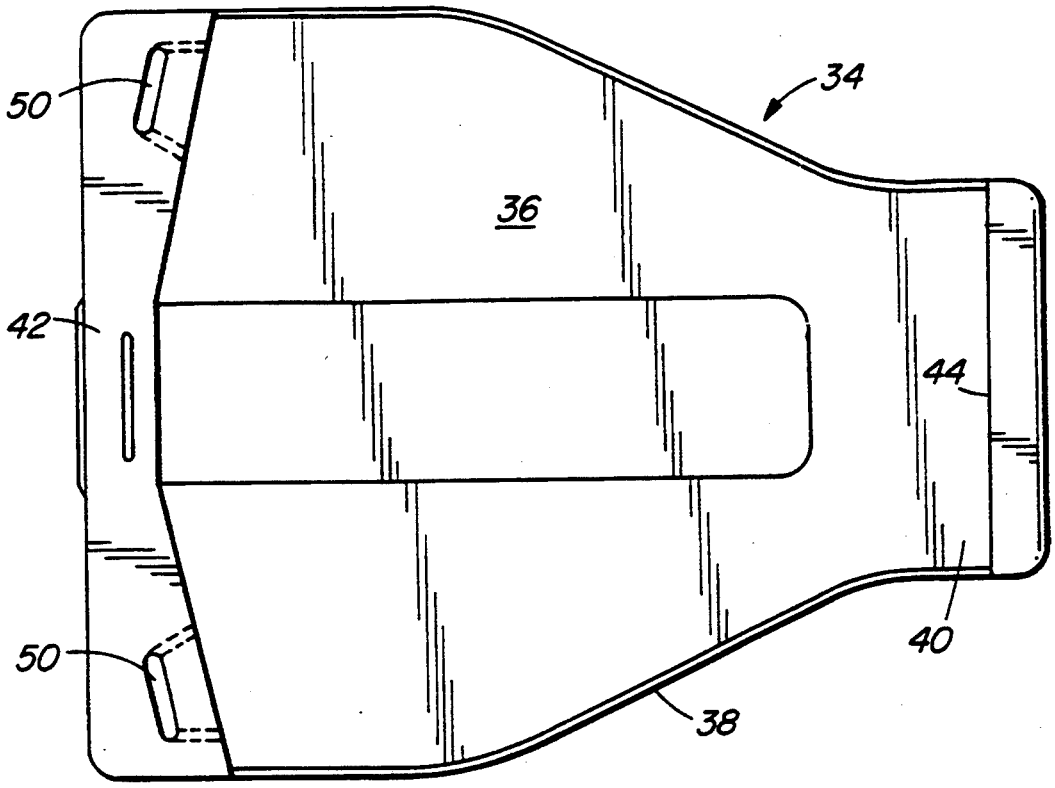
FIG. 5 is a bottom view of one embodiment of a cap according to the invention.
Figure 6:
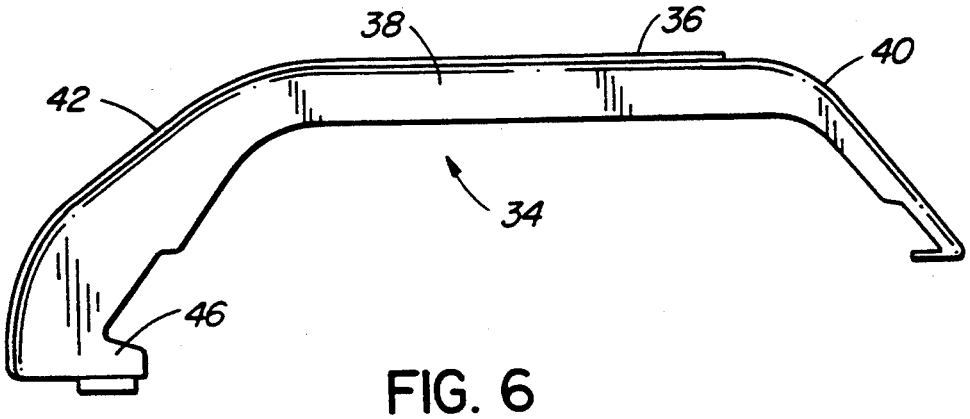
FIG. 6 is a side view of the cap shown in FIG. 5.

One embodiment of the cap is shown in FIGS. 5 and 6 and illustrates the cap having a main cover panel 36 with a pair of side panels 38 depending therefrom. Cap 36 has a nose portion 40 and a heel portion 42. As shown in FIG. 1, the heel and toe portions 42, 40 engage the underside of the ledge member 30 and the side panels 38 contact the upper surface of the ledge member.

As shown in FIGS. 1 and 6, the nose portion 40 of cap 34 has an inwardly turned lip 44 which engages the underside of the pool-side edge of the ledge member 30.

The heel portion 42 includes a pair of inwardly directed fingers 46 which engage the underside of the opposite edge of the ledge member 30 as shown in FIG. 1.

The cap 34 may be secured in position over the ledge member 30 in several ways,-one example being shown in FIG. 1 where a clip 48 is located in slots 50 (FIG. 5) and they include a set screw 52 which is threadably received in one arm of the clip and, as is evident from FIG. 1, when turned inwardly secures the heel portion 42 in position against the ledge member.

Figure 7:
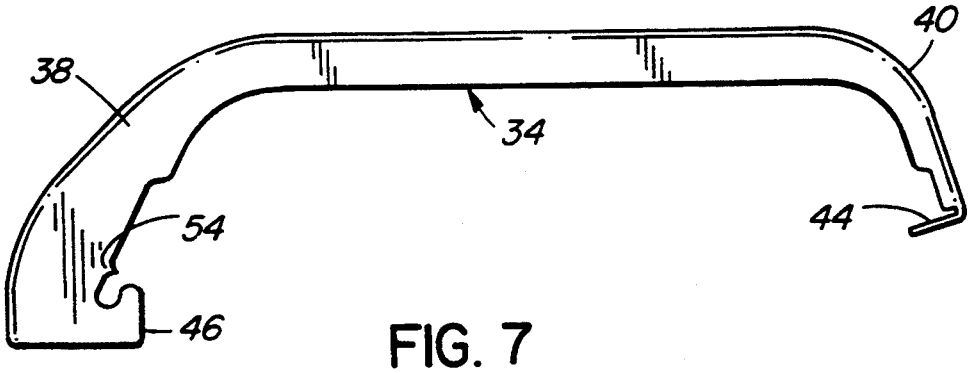
FIG. 7 is a side view of another embodiment of a cap according to the invention.
Figure 11:
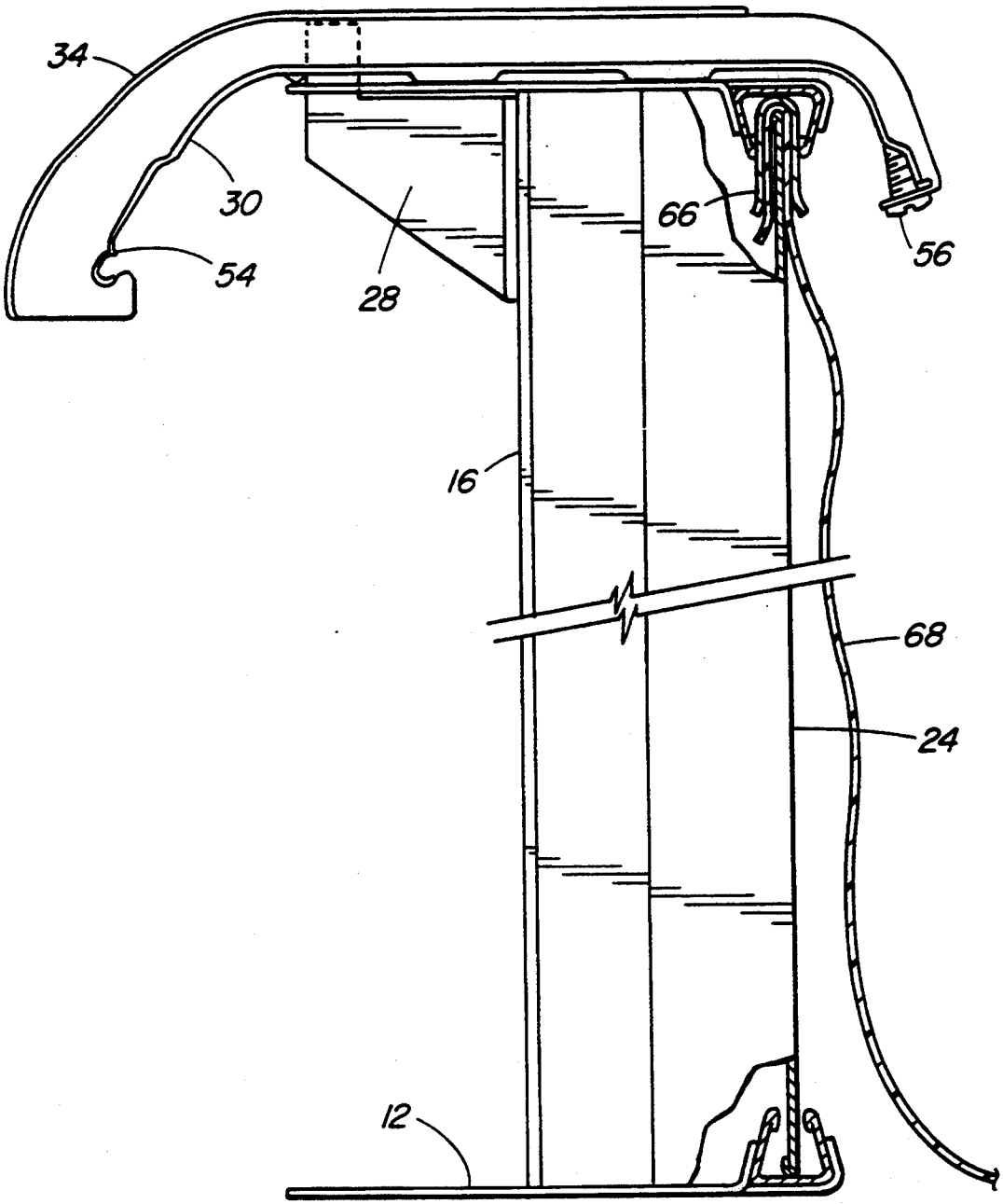
FIG. 11 is another side view similar to FIG. 1 but showing the use of a cap according to FIG. 7.
Figure 12:
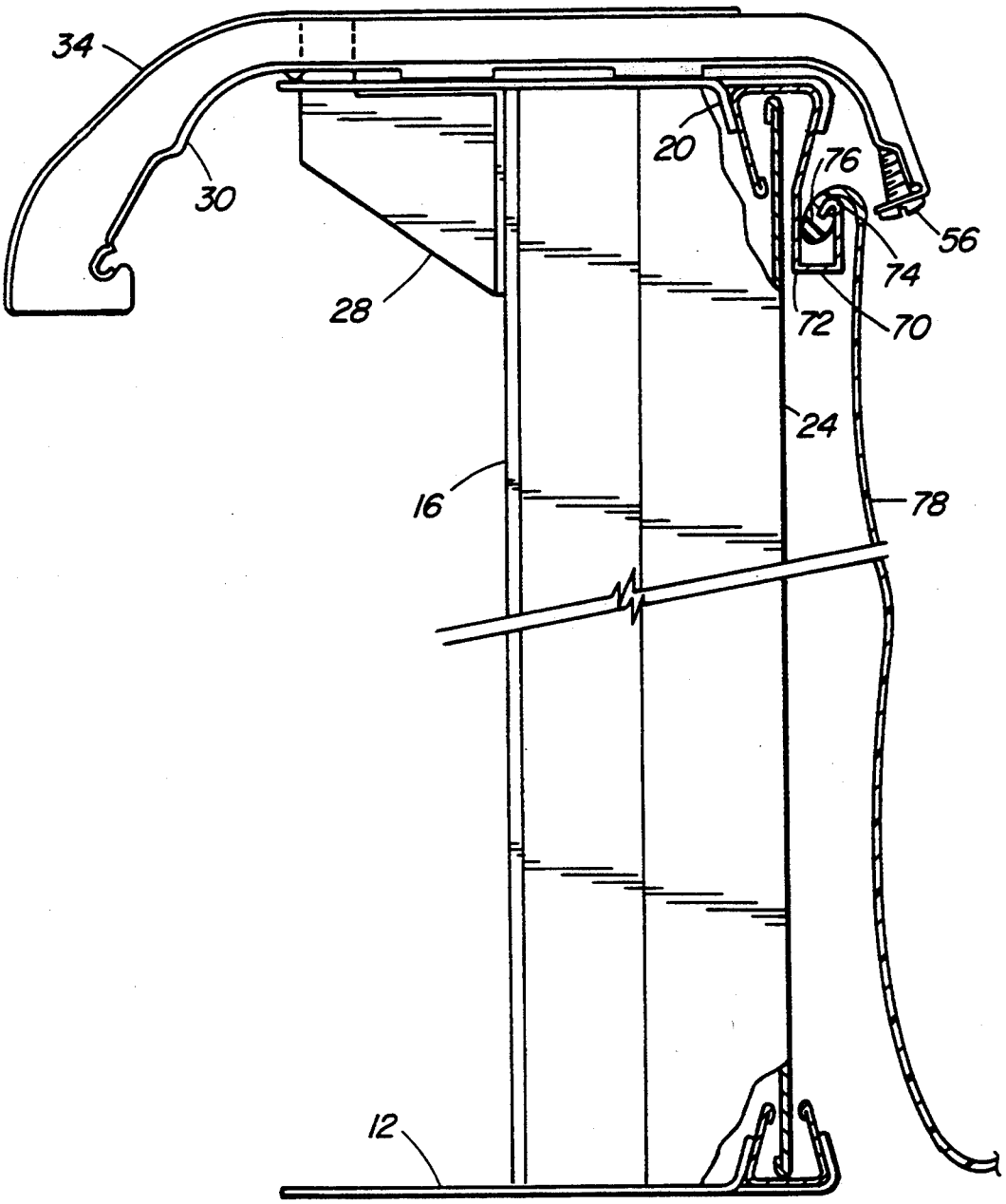
FIG. 12 is a view similar to FIG. 11 but showing a different form of upper track.

Another form of attachment is shown in FIG. 7 where the side wall 38 of the cap 34 is provided with an inwardly directed, sharp projection 54 which, as shown in FIGS. 11 and 12, puts a corresponding dent in the surface of the ledge 30 to hold the cap in place. When using this arrangement, the nose portion can be secured in several ways, one being shown in FIG. 12 where the lip 44 (FIG. 7) is provided with a securing screw 56 to prevent the nose portion from lifting.

Figure 13:
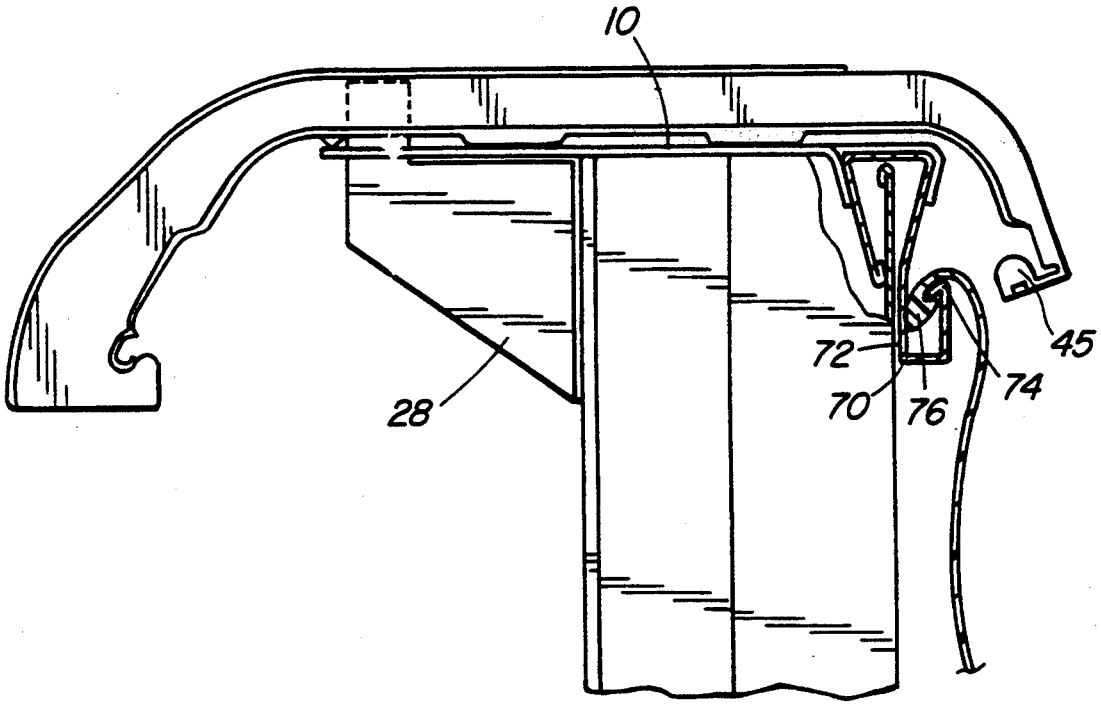
FIG. 13 is a view similar to FIG. 12 but showing an alternate form of attachment of one end of the cap.
Figure 14:
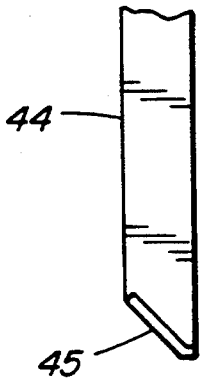
FIG. 14 is a view from the underside of the nose portion of the cap in FIG. 13.

In FIGS. 13 and 14, the two outside corners 45 of the lip 44 are turned upwardly and inwardly to capture and hold the nose portion against the top ledge 30.

Figure 9:
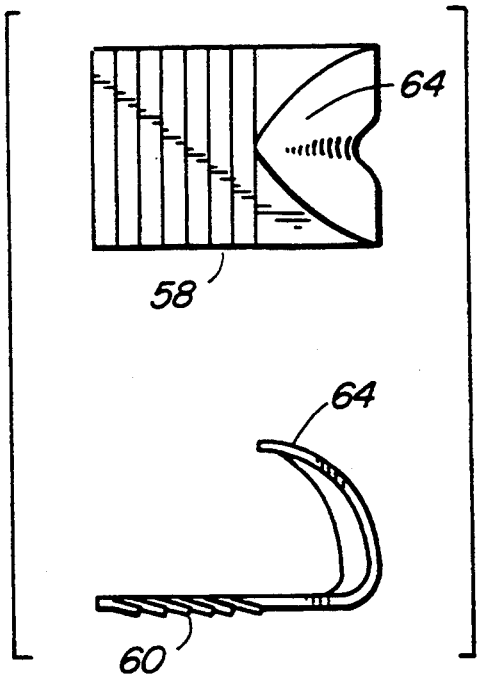
FIG. 9 is a side view of another form of cap securing clip.
Figure 10:
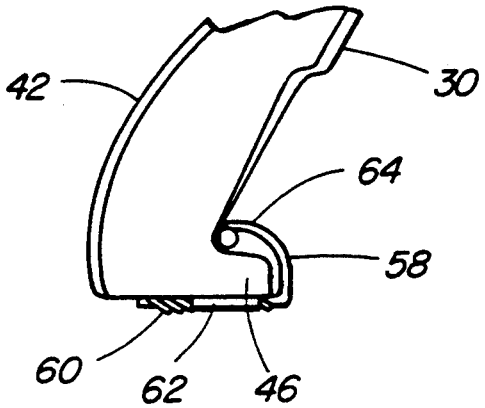
FIG. 10 is a fragmentary view of the clip of FIG. 9 in operative position.

Another form of securement is shown in FIGS. 9 and 10. In place of the screw clip 48 shown in FIG. 1, a generally L-shaped ratchet clip 58 is utilized. This clip has a serrated lower surface 60 which engages a tongue 62 that defines slots in the heel portion 42 of the cap. With the heel portion in place over the ledge member 30 as shown in FIG. 10, the ratchet clip 58 is driven home with the serrated surface 60 engaging the tongue 62 so that the inwardly turned point 64 engages the underside of the ledge 30 to secure the cap in place.

Figure 8:
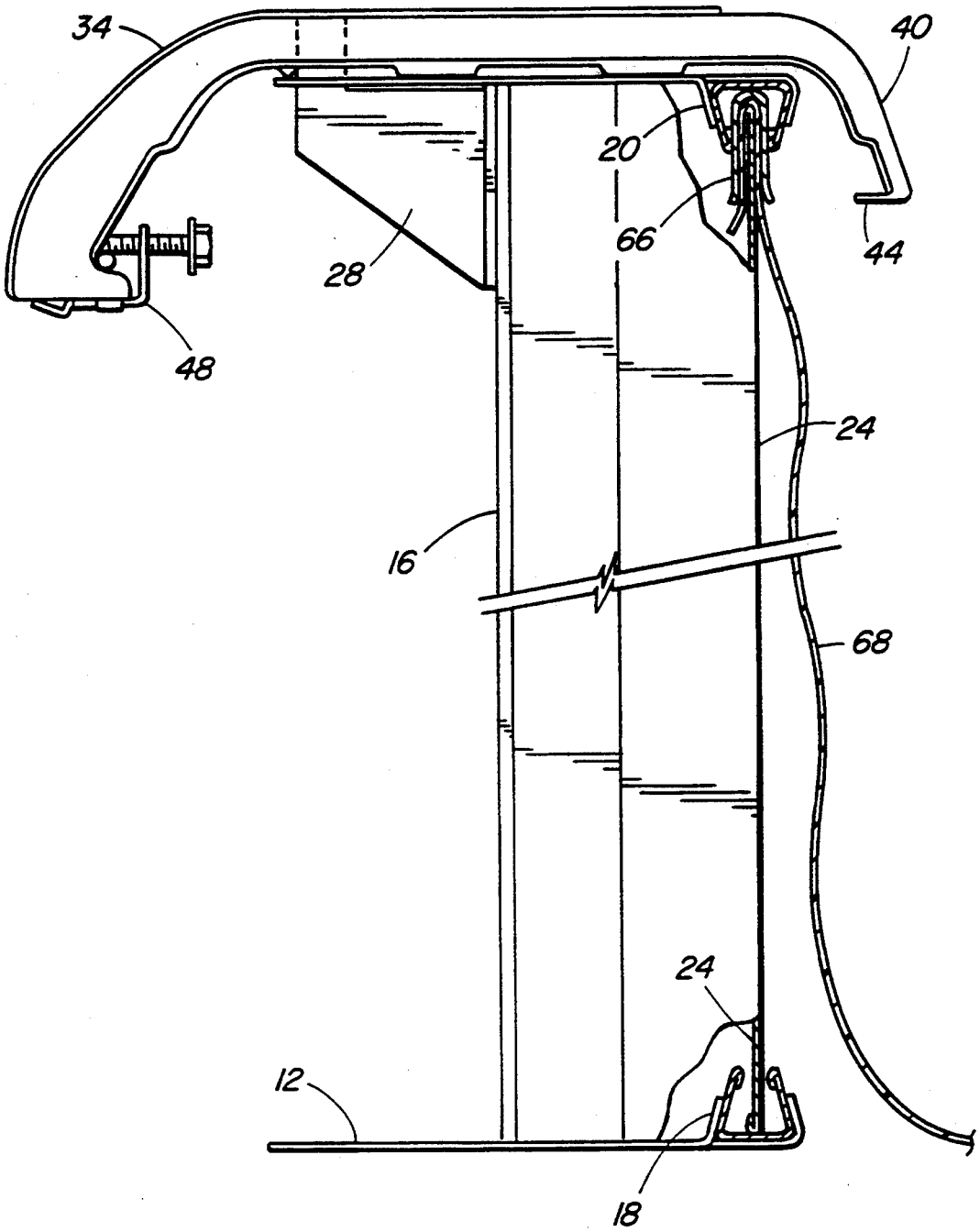
FIG. 8 is a view similar to FIG. 1 but incorporating a cap support member and illustrating one form of a cap securing clip.

In FIGS. 8 and 11, the upper track 20 includes an inner combing 66 which captures the upper end of a vinyl pool liner 68.

In FIGS. 12 and 13, a liner retaining top track 70 is utilized, this track having a pool-side channel 72 with an inwardly turned lip 74 for capturing the bead 76 as the upper end of a pool liner 78.

It will be appreciated that in all of the embodiments of the invention as illustrated the triangulated tracks and receptor means on the connectors 10 and 12 provide enhanced securement and stabilization to the edges of the pool wall. Additionally, the various means of securing the cap to the ledge member all include a form of securement that is not visible from the exterior of the assembly and this not only enhances the appearance of the design but it removes any bolt heads, clips or the like which might snag clothing of people in the vicinity of the assembly.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any eqilivalents of the features shown and described or portions thereof, but it is recognized that various modifications are possible within the scope of the invention claims.

I claim:

1. Apparatus for use in above-ground swimming pool construction wherein a perimeter pool wall is secured in position, said apparatus comprising:

(a) top and bottom connectors adapted to be secured, respectively, to upper and lower edges of said wall;

(b) upper and lower tracks for receiving said upper and lower edges of the wall;

(c) track receptors on said connectors for receiving and retaining said tracks on said connectors;

(d) ledge members covering the upper edges of said wall and extending between and being secured to said top connectors;

(e) a cap covering each top connector and terminal ends the ledge members secured thereto;

(f) said tracks and said track receptors having a generally triangular configuration in cross-section; and, (g) said cap comprising means for fixing said cap over said ledge members and said top connector, including a main cover panel with a pair of side panels depending therefrom, said side panels defining a nose portion and a heel portion located at opposite ends of said main panel, said heel and toe portions each having a terminal end engaging an underside of said ledge members and said main cover panel engaging an upper surface thereof; and, (h) said nose portion including an inwardly turned lip which engages the underside of said ledge members, and wherein said heel portion of said cap includes a projecting portion which, when said cap is mounted over said ledge members, applies a dent in the upper surface of the ledge members to assist in securing the cap in place.

2. Apparatus according to claim 1 including vertical post members located exteriorly of said wall and being secured to said top and bottom connectors.

3. Apparatus according to claim 1 wherein said connectors comprise a plate having a first plurality of tabs for receiving and connecting terminal ends of vertical posts associated with said wall thereto, and said track receptors comprising a second plurality of tab members defining a triangulated portion for receiving said track therein.

4. Apparatus according to claim 1 wherein said upper track includes an inner combing which captures an upper end of a pool liner.

5. Apparatus according to claim 1 wherein said upper track includes a channel with a bead-retaining lip thereon.

* * * * *